US007596867B1

(12) United States Patent
Biolchini, Jr.

(10) Patent No.: US 7,596,867 B1
(45) Date of Patent: Oct. 6, 2009

(54) UTILITY KNIFE SYSTEM

(76) Inventor: Robert F. Biolchini, Jr., P.O. Box 613, Jackson, WY (US) 83001

( * ) Notice: Subject to any disclaimer, the term of this patent is extended or adjusted under 35 U.S.C. 154(b) by 463 days.

(21) Appl. No.: 11/462,208

(22) Filed: Aug. 3, 2006

(51) Int. Cl.
*B26B 5/00* (2006.01)
*B26B 29/00* (2006.01)

(52) U.S. Cl. ..... 30/125; 30/151; 30/331; 30/339

(58) Field of Classification Search ..... 30/151, 30/337, 339, 125, 286, 330–331, 162, 163, 30/2, 161, 280
See application file for complete search history.

(56) References Cited

U.S. PATENT DOCUMENTS

| | | | | | |
|---|---|---|---|---|---|
| 3,906,625 | A * | 9/1975 | Gringer | 30/125 |
| 3,943,627 | A * | 3/1976 | Stanley, Jr. | 30/151 |
| 4,005,525 | A * | 2/1977 | Gringer | 30/125 |
| 4,086,698 | A * | 5/1978 | Sparks | 30/2 |
| 4,091,537 | A * | 5/1978 | Stevenson, Jr. | 30/286 |
| 4,240,202 | A * | 12/1980 | Gilbert | 30/162 |
| 4,936,014 | A * | 6/1990 | Shaanan et al. | 30/162 |
| 4,939,839 | A * | 7/1990 | Gorst | 30/125 |
| 5,864,952 | A * | 2/1999 | Chung | 30/162 |
| 5,878,501 | A * | 3/1999 | Owens et al. | 30/286 |
| 6,233,830 | B1 * | 5/2001 | Lamond et al. | 30/123 |
| 6,233,832 | B1 * | 5/2001 | Berns | 30/162 |
| 6,349,473 | B1 * | 2/2002 | Schmidt | 30/162 |
| 6,718,637 | B1 * | 4/2004 | Ortner et al. | 30/2 |
| 6,718,640 | B1 * | 4/2004 | John | 30/162 |
| 6,968,622 | B2 | 11/2005 | Ping | |
| 7,131,204 | B2 * | 11/2006 | Brown et al. | 30/162 |
| 2005/0055833 | A1 * | 3/2005 | Scarla | 30/156 |
| 2007/0011882 | A1 * | 1/2007 | Ping | 30/162 |

* cited by examiner

*Primary Examiner*—Boyer D. Ashley
*Assistant Examiner*—Laura M. Lee
(74) *Attorney, Agent, or Firm*—David A. Guerra

(57) ABSTRACT

A utility knife system for cutting objects The utility knife system has an external handle, a retractable sheath, a retracting mechanism, and an internal housing. The external handle has a sheath sliding track running longitudinally therein and a hinge. The retractable sheath has at least one protrusion that corresponds to the shape of the sheath sliding track, slides within the external handle. The retracting mechanism moves the retractable sheath and locks it in a desired position. The internal housing is received within the retractable sheath and the external handle, and has a hinge attachable to the hinge of the external handle, and a blade retention end opposite of the hinge. The blade retention end receives a cutting blade.

20 Claims, 16 Drawing Sheets

UTILITY KNIFE SYSTEM

BACKGROUND OF THE INVENTION

1. Field of the Invention

The utility knife system has particular utility in connection with cutting objects safely and effectively while allowing for the easy replacement of dull disposable cutting blades.

2. Description of the Prior Art

Utility knife systems are desirable for cutting objects safely and effectively, and at the same time allowing for the easy and quick replacement of dull blades without the need for tools to disassemble the utility knife. Additionally, utility knife systems of the present invention are advantageous in that they provide users the ability to apply tremendous amounts of downward pressure to a handle of the utility knife system while cutting an object. This is beneficial in that thicker and denser objects can be cut without damage to the utility knife or injury to the user.

The use of standard utility knives is known in the prior art, and are typically used in the construction industry, in the office place, and in everyday life. These standard utility knives use a standard replaceable blade that can be replaced with a new blade once the old blade becomes dull. Normally, a user would have to disassemble the utility knife into two halves. This design makes for an unstable casing when in use and increases the chances of injury by the user since the two halves are secured by a single fastener and pressure from the blade is transmitted to the longitudinal connection line of the halves. Additionally, the blade can be dislodged if to much force is applied to the utility knife. An example of a known utility knife is in U.S. Pat. No. 6,968,622 to Ping.

While the above-described devices fulfill their respective, particular objectives and requirements, the aforementioned patents do not describe a utility knife system that allows cutting objects safely and effectively.

Therefore, a need exists for a new and improved utility knife system that can be used for cutting objects safely and effectively, while allowing for the easy replacement of dull disposable cutting blades. In this regard, the present invention substantially fulfills this need. In this respect, the utility knife system according to the present invention substantially departs from the conventional concepts and designs of the prior art, and in doing so provides an apparatus primarily developed for the purpose of cutting objects safely and effectively.

SUMMARY OF THE INVENTION

In view of the foregoing disadvantages inherent in the known types of standard utility knives now present in the prior art, the present invention provides an improved utility knife system, and overcomes the above-mentioned disadvantages and drawbacks of the prior art. As such, the general purpose of the present invention, which will be described subsequently in greater detail, is to provide a new and improved utility knife system and method which has all the advantages of the prior art mentioned heretofore and many novel features that result in a utility knife system which is not anticipated, rendered obvious, suggested, or even implied by the prior art, either alone or in any combination thereof.

To attain this, the present invention essentially comprises a utility knife system for cutting objects safely and effectively, while allowing for the easy replacement of dull disposable cutting blades. The utility knife system has an external handle, a retractable sheath, a retracting mechanism, and an internal housing. The external handle includes at least one sheath sliding track running longitudinally therein and a hinge. The retractable sheath has at least one protrusion that corresponds to the shape of the sheath sliding track, and is adapted to slide within the external handle. The retracting mechanism is adapted to move the retractable sheath and to lock it in a desired position. The internal housing is configured to be received within the retractable sheath and the external handle, and has a hinge attachable to the hinge of the external handle, and a blade retention end opposite of the hinge. The blade retention end is adapted to receive a cutting blade. The arm is rotatably attachable to the internal housing and has a rotatable attachment point and a wedge adapted to secure a cutting blade in the blade retention end when the arm is rotated down.

The external handle additionally can have at least one locking cutout. Furthermore, the retracting mechanism additionally can have a leaf spring trigger and at least one locking finger. The retracting mechanism is attachable to the retractable sheath allowing for the locking finger to engage with the locking cutout of the external handle.

There has thus been outlined, rather broadly, the more important features of the invention in order that the detailed description thereof that follows may be better understood and in order that the present contribution to the art may be better appreciated.

The invention may also include a running bar removably attachable to the external handle and located adjacent the locking cutout. The running bar is adapted to make contact with the locking finger of the retracting mechanism.

Additionally, the retractable sheath can further have at least one extension positioned in a defined opening. The external handle additionally can have a coil spring and a coil spring holder removable attachable to the external handle and positionable within the opening of the retractable sheath. The coil spring being positioned between the coil spring holder and the extension of the retractable sheath.

There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved utility knife system that has all of the advantages of the prior art standard utility knives and none of the disadvantages.

It is another object of the present invention to provide a new and improved utility knife system that may be easily and efficiently manufactured and marketed.

An even further object of the present invention is to provide a new and improved utility knife system that has a low cost of manufacture with regard to both materials and labor, and which accordingly is then susceptible of low prices of sale to the consuming public, thereby making such utility knife system economically available to the buying public.

Still another object of the present invention is to provide a new utility knife system that provides in the apparatuses and methods of the prior art some of the advantages thereof, while simultaneously overcoming some of the disadvantages normally associated therewith.

Even still another object of the present invention is to provide a utility knife system for cutting objects safely and effectively. This allows for a user to securely and safely operate with enough force to cut through the desired object without damaging the utility knife or injuring the user. The present invention also allows for quick and easy cutting blade replacement without the need for extra tools.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
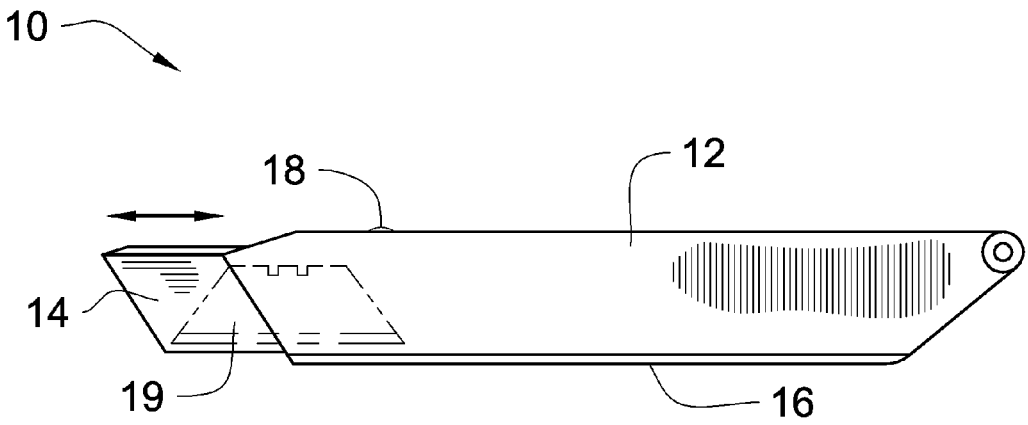
FIG. 1 is a front elevational view of the preferred embodiment of the utility knife system constructed in accordance with the principles of the present invention.

Referring now to the drawings and particularly to FIGS. 1-29, an embodiment of the utility knife system of the present invention is shown and generally designated by the reference numeral 10.

Figure 3:
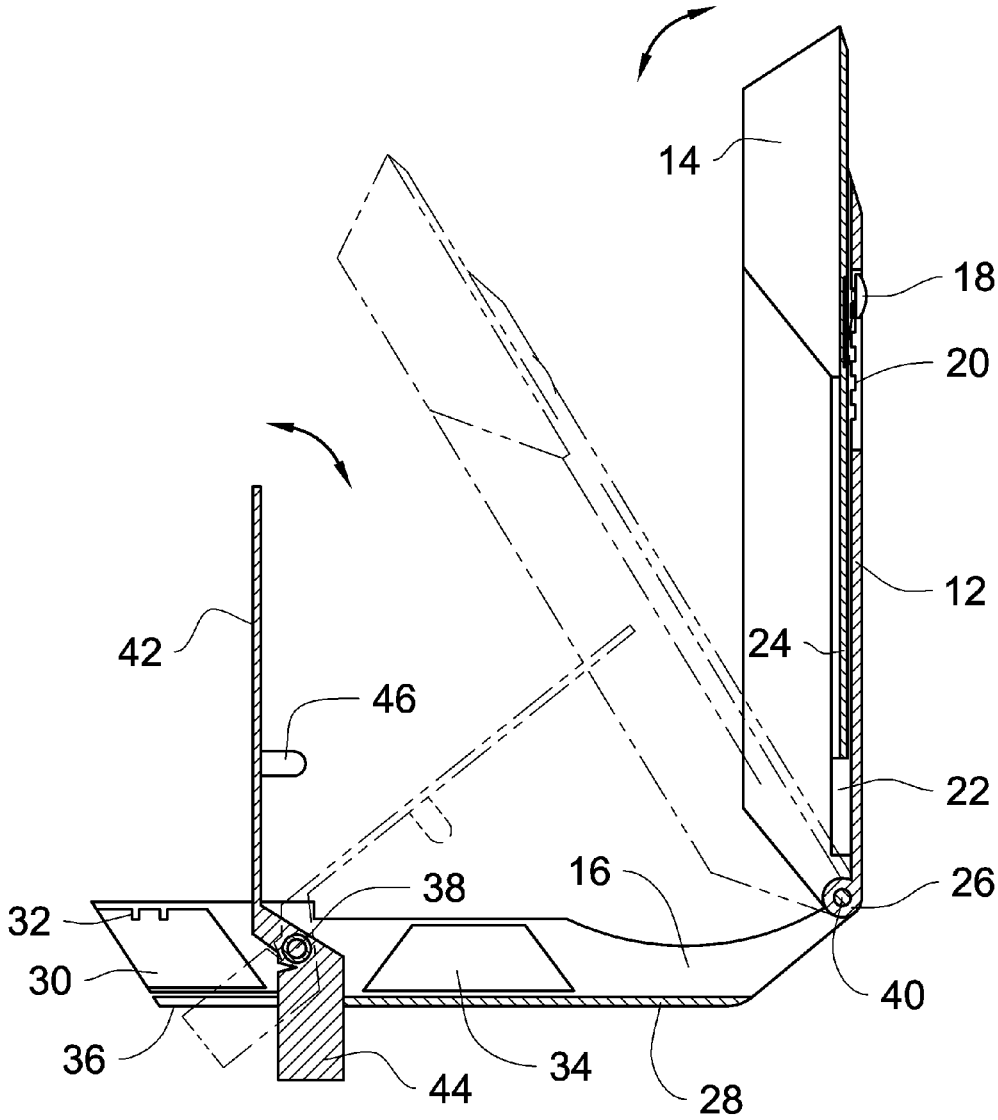
FIG. 3 is an exploded partial cross-sectional view of the utility knife system of the present invention.

In FIG. 1, a new and improved utility knife system 10 of the present invention for cutting objects safely and effectively while allowing for quick and easy replacement of dull blades is illustrated and will be described. More particularly, the utility knife system 10 has an external handle 12 hingedly attachable to an internal housing 16, a retractable sheath 14 adapted to be slidably received within the external handle 12, and a rotating arm 42, as best illustrated in FIG. 3.

Figure 2:
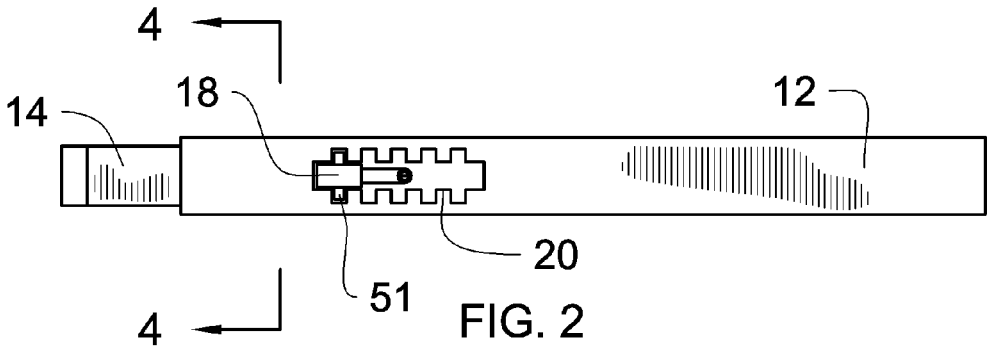
FIG. 2 is a top plane view of the utility knife system of the present invention.

The retractable sheath 14 is able to slide and retain its position with the external handle 12 via a retracting mechanism 18 which engages a plurality of locking cutouts 20 located in the external handle 12, as shown in FIG. 2.

The internal housing 16 has a support ridge 28, a cutting blade seat 30, a cutting blade storage area 34, an open bottom end 36, an arm pivot pin or point 38, and a handle pivot pin or point 40. The cutting blade seat 30 features cutting blade retaining prongs 32 that extend into the cutting blade seat 30 and secure a cutting blade 19 therein. The cutting blade retaining prongs 32 prevents the cutting blade 19 from moving forward and collapsing into the external handle 12 and sheath 14. The arm pivot pin 38 is positioned between the blade seat 30 and the blade storage area 34.

Figure 4:
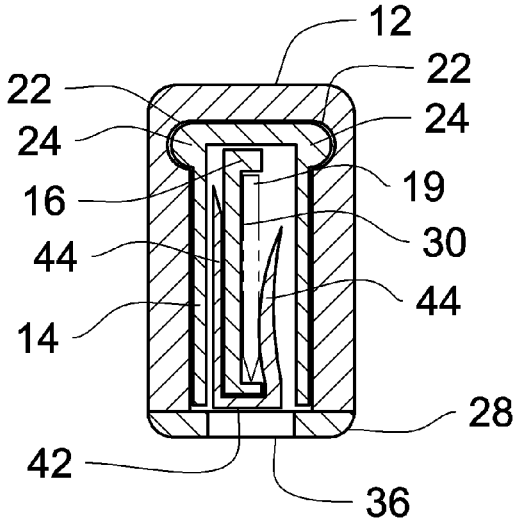
FIG. 4 is a cross-sectional view of the utility knife system of the present invention.

The support ridge 28 is a flange that extends outward from both sides of the internal housing 16 thereby producing a generally T-shaped configuration, thereby supporting the external handle 12 when in a closed position. Preferably, the support ridge 28 is at least the same width as the external handle 12, as best illustrated in FIG. 4. The bottom of the internal housing 16 can be ergonomically designed to allow a user to have a more comfortable and secure grip. A key design feature of the present invention is how the external handle 12, when closed, comes in contact with the internal housing support ridge 28. This design feature allows the user to apply tremendous amounts of downward pressure to the external handle 12 while cutting an object. All the stress will be carried be the support ridge 28 and the bottom part of the legs of the horseshoe shaped external handle 12.

Figure 5:
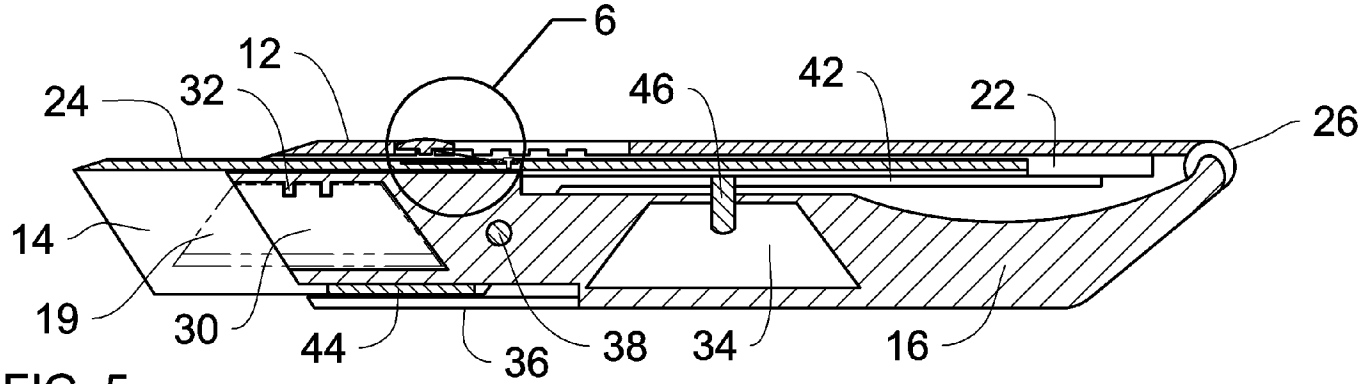
FIG. 5 is a cross-sectional view of the utility knife system of the present invention.

The following primary design feature of the present invention is common through all embodiments. The external handle 12 has three sides giving it a generally U-shape or horseshoe configuration, which encases the internal housing 16. The external handle 12 has at least one sheath sliding track 22 running longitudinal therein on its top side, and a hinge 26 located opposite the locking cutouts 20. The locking cutouts 20 provide an opening for the retracting mechanism 18 to extend therethrough, allowing the user access and operation thereof. The hinge 26 is removably or fixedly attached to the pivot pin 40 of the internal housing 16. The handle pivot pin 40 and hinge 26 is design to have tight tolerances to create a fair degree of friction. This friction in the handle pivot pin 40 and hinge 26 connection is what will hold the external handle 12 and internal housing 16 in a closed and/or open position. The external handle 12 can be ergonomically designed to allow a user to have a more comfortable and secure grip The rotating arm 42 has a wedge 44 and an extension 46. The rotating arm 42 is pivotably attachable to the arm pivot pin 38 of the internal housing 16. The pivot attachment point is positioned adjacent the wedge 44 and before the extension. The extension 46 is configured to retain, when closed, any cutting blades 19 stored in the cutting blade storage area 34 of the internal housing 16. The wedge 44 has two sides which make contact with the cutting blade 19 and the backside of the blade seat 30, with the side making contact having an arcuate shape. The wedge 44 is designed to pass through the open end 36 of the external handle 12. When the arm 42 is closed, it will fit within the internal housing 16, thereby being enclosed by the external housing 12 and the sheath 14, as best illustrated in FIGS. 3, 4 and 5.

The retractable sheath 14 has the same configuration as the external handle 12, and is adapted to slide therein along the track 22. The sheath 14 has protrusions 24 that extend out and correspond to the shape of the tracks 22. The sheath 14 is designed to cover the blade 19 when it is extended out from the external handle 12, thereby protecting the blade 19 and the user. The movement of the sheath 14 is accomplished by the retracting mechanism 18.

Figure 6:
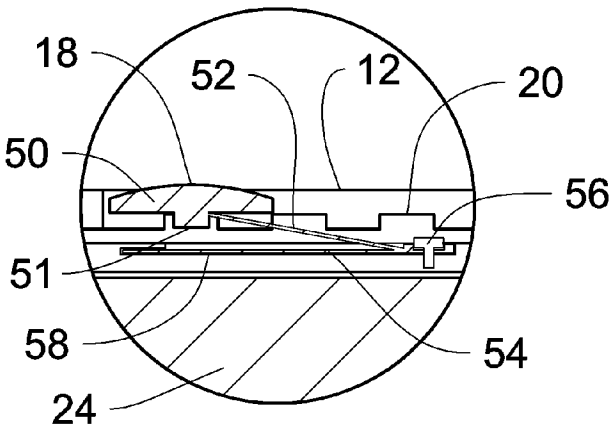
FIG. 6 is an enlarged cross-sectional view of the locking mechanism utility knife system of the present invention.

FIG. 6 best illustrates the retracting mechanism 18 which includes a leaf spring trigger 50 featuring locking fingers 51 extending out therefrom, a leaf spring 52, and a base 54. A fastener 56 secures the retracting mechanism 18 in a notch 58 of the sheath 14. The locking fingers 51 are adapted to be received and secured in the locking cutouts 20 of the external handle 12. The user would press down on the leaf spring trigger 50, thereby disengaging the locking fingers 51 from the locking cutouts 20. This allows the user to moving the retracting mechanism 18 thereby moving the sheath 14. When the desired position of the sheath 14 is reached, the user would take pressure off the leaf spring trigger 50, allowing the locking finger 51 to engage the locking cutout 20.

Figure 7:
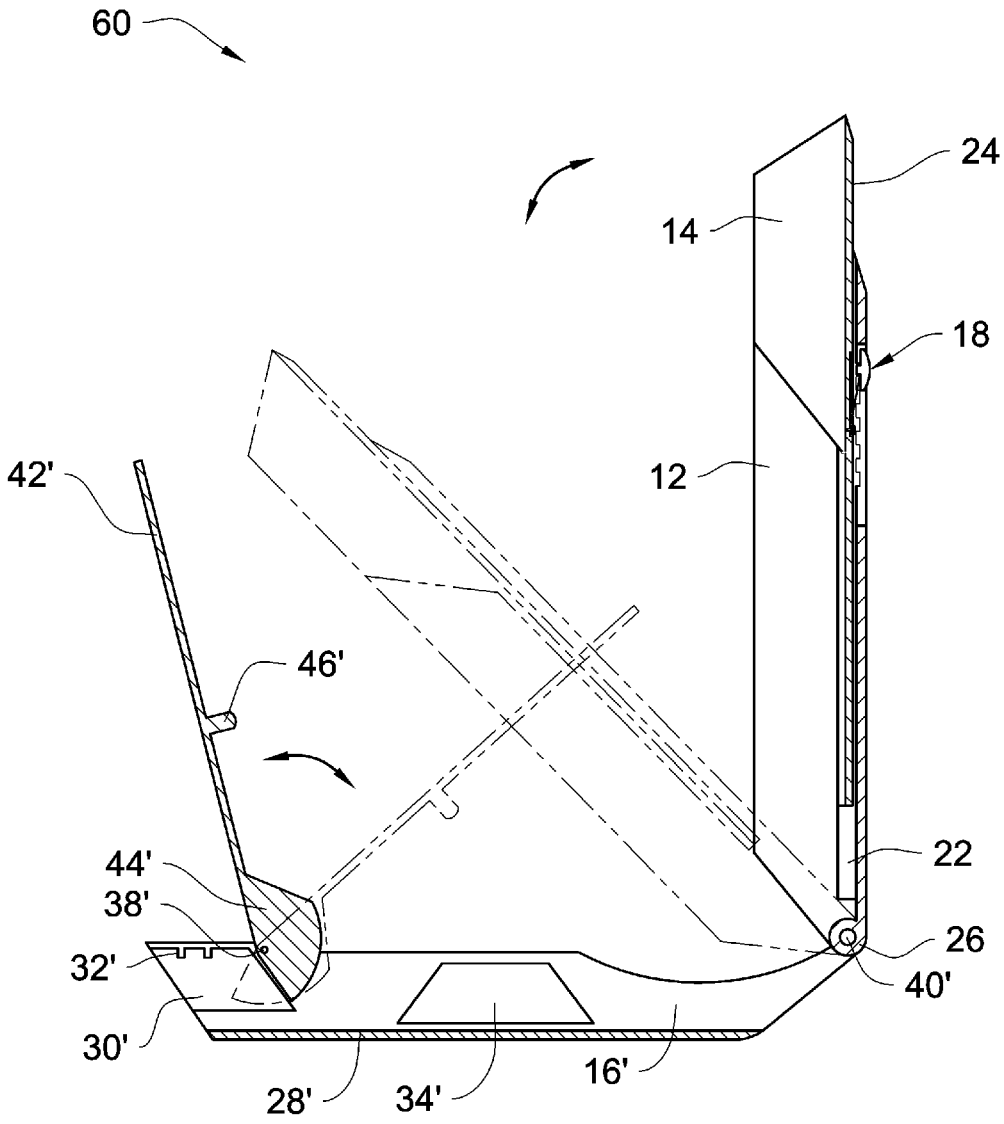
FIG. 7 is an exploded partial cross-sectional view an alternate embodiment of the utility knife system of the present invention.

FIG. 7 illustrates an alternate embodiment 60 of the present invention. The embodiment 60 is similar to the embodiment 10, but with a modified internal housing 16' and rotating arm 42'.

Figure 8:
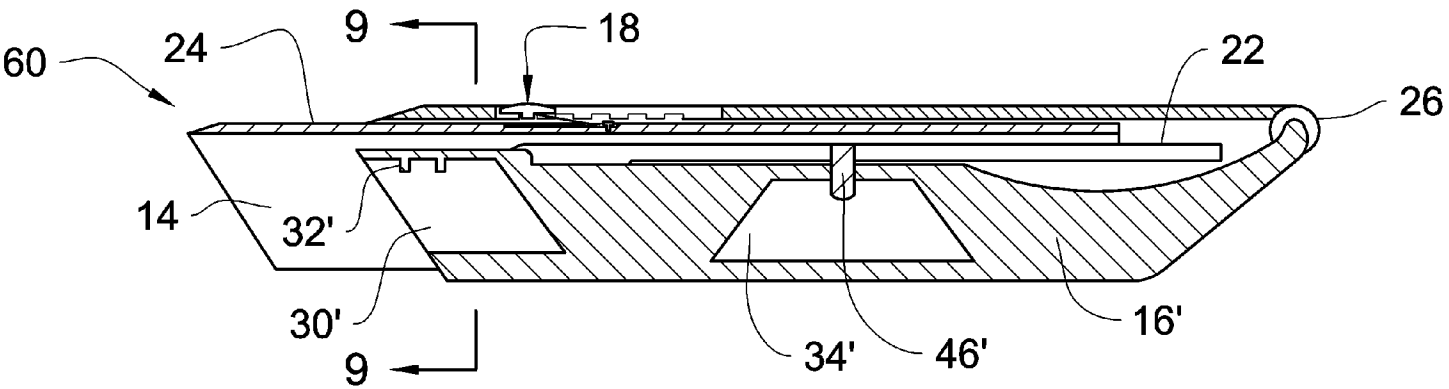
FIG. 8 is a cross-sectional view of the alternate embodiment of the utility knife system of the present invention in FIG. 7.

The external handle 12, the retractable sheath 14, and the retracting mechanism 18 are identical to that of embodiment 10, as describe above, and are incorporated into embodiment 60. The operation and closed configuration of embodiment 60 is best illustrated in FIGS. 7 and 8.

The internal housing 16' has a support ridge 28', a cutting blade seat 30', a cutting blade storage area 34', an arm pivot pin or point 38', and a handle pivot pin or point 40'. The cutting blade seat 38' features cutting blade retaining prongs 32' that extends into the cutting blade seat 30' and secures a cutting blade 19 therein. The cutting blade retaining prongs 32' prevents the cutting blade 19 from moving forward and collapsing into the external handle 12 and sheath 14. The arm pivot pin 38' is positioned adjacent the blade seat 30', preferable behind and above the blade seat 30'.

Figure 9:
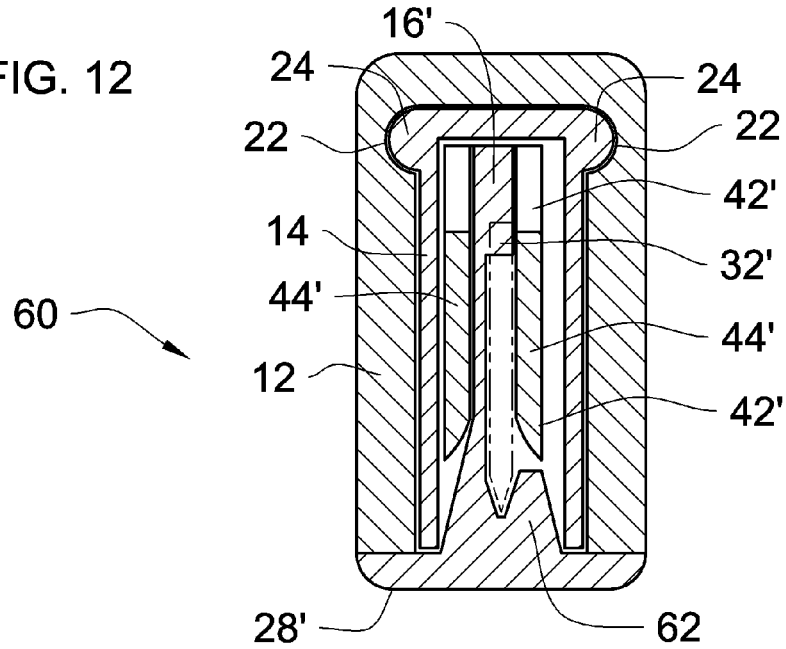
FIG. 9 is a cross-sectional view of the alternate embodiment of the utility knife system of the present invention in FIG. 8.

The support ridge 28' is a flange that extends outward from both sides of the internal housing 16' thereby producing a generally T-shaped configuration, thereby supporting the external handle 12 when in a closed position. Preferably, the support ridge 28' is the same width as the external handle 12, as best illustrated in FIG. 9. The bottom of the internal housing 16' can be ergonomically designed to allow a user to have a more comfortable and secure grip. A key design feature of the present invention is how the external handle 12, when closed, comes in contact with the internal housing support ridge 28'. This design feature allows the user to apply tremendous amounts of downward pressure to the external handle 12 while cutting an object. All the stress will be carried be the support ridge 28' and the bottom part of the legs of the horseshoe shaped external handle 12.

The rotating arm 42' has a wedge 44' and an extension 46'. The rotating arm 42' is pivotably attachable to the arm pivot pin 38' of the internal housing 16'. The pivot attachment point is positioned within the area of the wedge 44'. The extension 46' is configured to retain, when closed, any cutting blades 19 stored in the cutting blade storage area 34' of the internal housing 16'. The wedge 44' has two sides which makes contact with the cutting blade 19 and the backside of the blade seat 30'. The side of wedge 44' that makes contact with blade 19 can be arcuate. When the arm 42' is closed, it will fit within the internal housing 16', thereby being enclosed by the external housing 12 and the sheath 14, as best illustrated in FIGS. 7,8, and 9.

Figure 10:
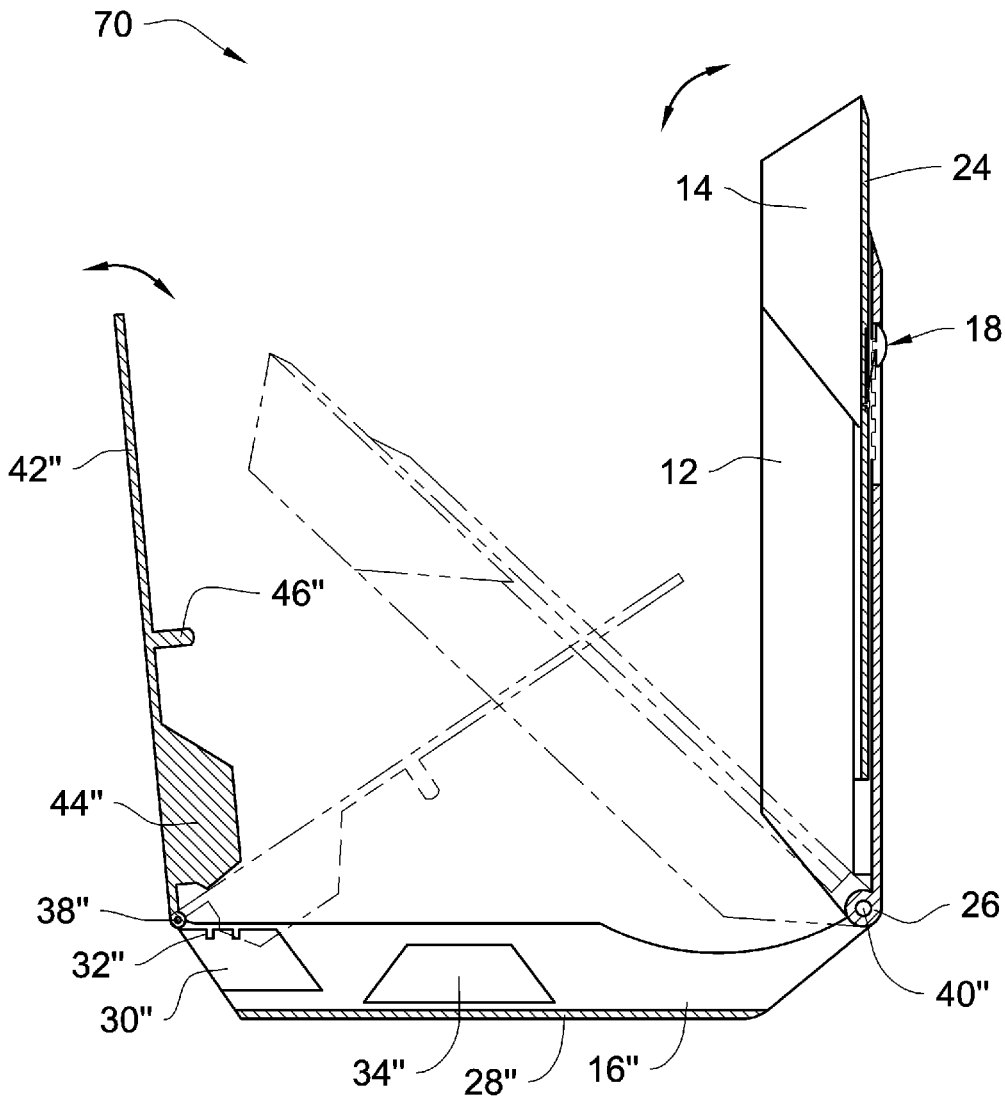
FIG. 10 is an exploded partial cross-sectional view of an alternate embodiment of the utility knife system of the present invention.

FIG. 10 illustrates an alternate embodiment 70 of the present invention. The embodiment 70 is similar to the embodiment 10, but with a modified internal housing 16" and rotating arm 42".

Figure 11:
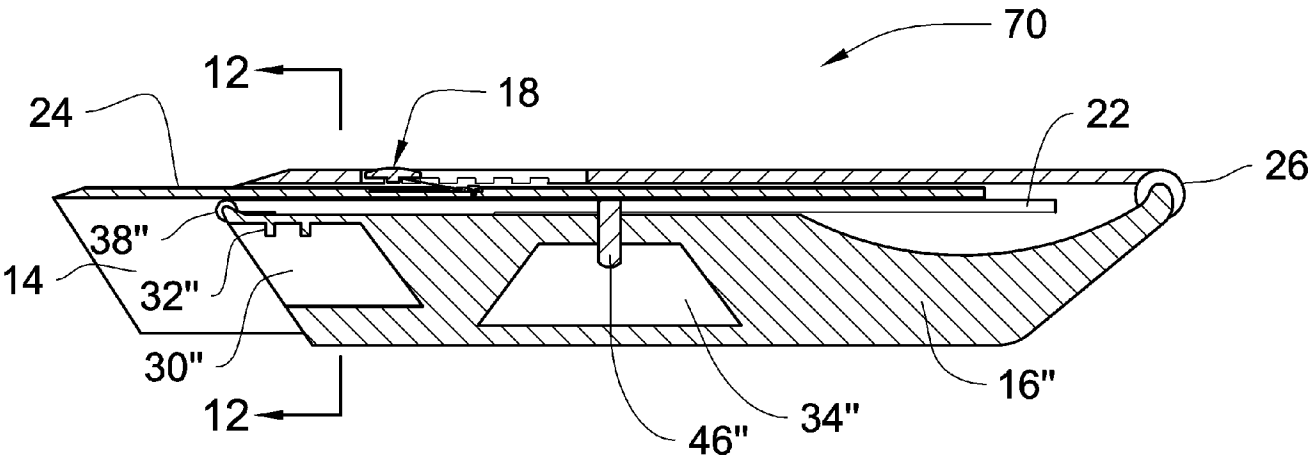
FIG. 11 is a cross-sectional view of the alternate embodiment of the utility knife system of the present invention in FIG. 10.

The external handle 12, the retractable sheath 14, and the retracting mechanism 18 are identical to that of embodiment 10, as describe above, and are incorporated into embodiment 70. The operation and closed configuration of embodiment 60 is best illustrated in FIGS. 10 and 11.

The internal housing 16" has a support ridge 28", a cutting blade seat 30", a cutting blade storage area 34', an arm pivot pin or point 38", and a handle pivot pin or point 40". The cutting blade seat 30" features cutting blade retaining prongs 32" that extends into the cutting blade seat 30" and secures a cutting blade 19 therein. The cutting blade retaining prongs 32" prevents the cutting blade 19 from moving forward and collapsing into the external handle 12 and sheath 14. The arm pivot pin 38" is positioned adjacent the blade seat 30', preferable above the blade seat 30" and at the distal end of internal housing 16".

Figure 12:
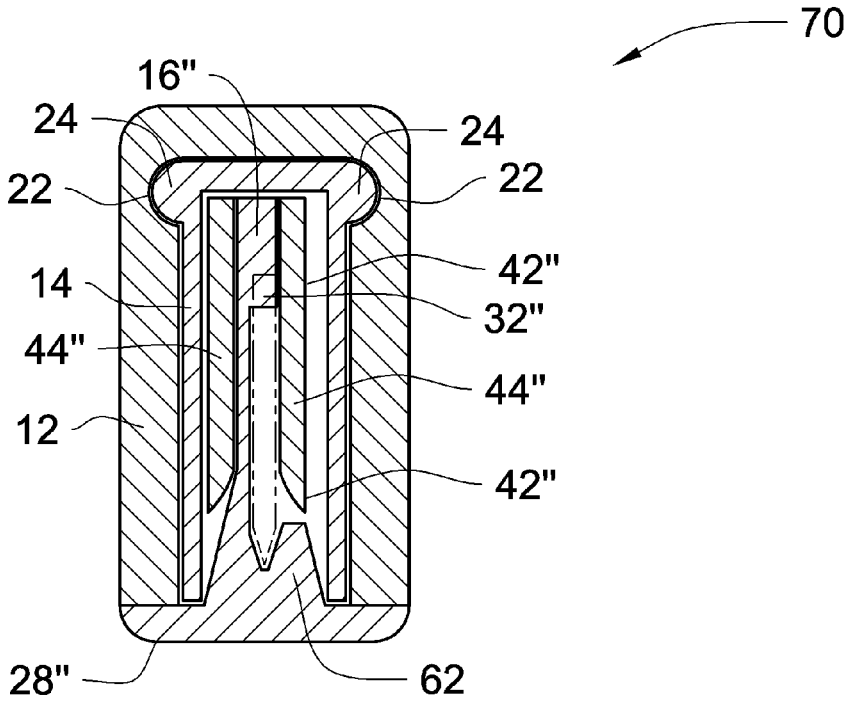
FIG. 12 is a cross-sectional view of the alternate embodiment of the utility knife system of the present invention in FIG. 11.

The support ridge 28" is a flange that extends outward from both sides of the internal housing 16" thereby producing a generally T-shaped configuration, thereby supporting the external handle 12 when in a closed position. Preferably, the support ridge 28" is the same width as the external handle 12, as best illustrated in FIG. 12. The bottom of the internal housing 16" can be ergonomically designed to allow a user to have a more comfortable and secure grip. A key design feature of the present invention is how the external handle 12, when closed, comes in contact with the internal housing support ridge 28". This design feature allows the user to apply tremendous amounts of downward pressure to the external handle 12 while cutting an object. All the stress will be carried be the support ridge 28" and the bottom part of the legs of the horseshoe shaped external handle 12.

The rotating arm 42" has a wedge 44' and an extension 46". The rotating arm 42" is pivotably attachable to the arm pivot pin 38" of the internal housing 16". The pivot attachment point is positioned ahead of the wedge 44" at the distal end of the arm 42". The extension 46" is configured to retain, when closed, any cutting blades 19 stored in the cutting blade storage area 34" of the internal housing 16". The wedge 44" has two sides which makes contact with the cutting blade 19 and the backside of the blade seat 30". The side of wedge 44" that makes contact with blade 19 can be arcuate. When the arm 42" is closed, it will fit within the internal housing 16", thereby being enclosed by the external housing 12 and the sheath 14, as best illustrated in FIGS. 10, 11, and 12.

An alternate embodiment of the external handle 12 and retractable sheath 14 is shown in FIGS. 13-16. This embodiment is a spring loaded design which can be incorporated into the manufacturing process or be added as an aftermarket option by simply replacing the original external handle 12 with the alternate embodiment external handle 12' and sheath 14'. The retractable sheath 14' is able to retain its positions with the external handle 12' via a retracting mechanism 18 which engages a plurality of locking cutouts 20' in the external handle 12', in the same manner as described above in embodiment 10. The retractable sheath 14' has protrusions 24' which enable it to slide along sliding track 22' of the external handle 12'.

Figure 13:
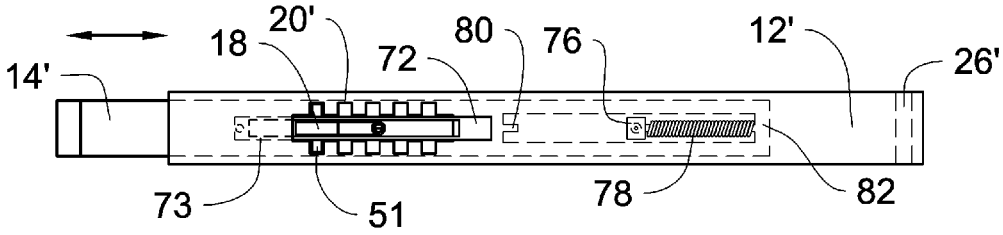
FIG. 13 is a top plane view of an alternate embodiment of the external handle and retractable sheath of the utility knife system of the present invention.
Figure 14:
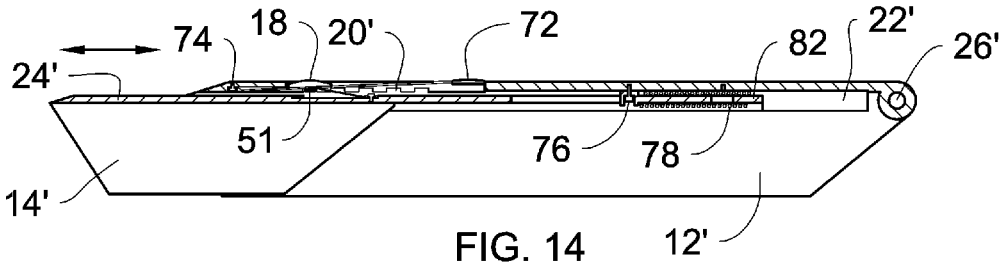
FIG. 14 is a front elevational view of the alternate embodiment of the external handle and retractable sheath of the utility knife system of the present invention in FIG. 13.
Figure 15:
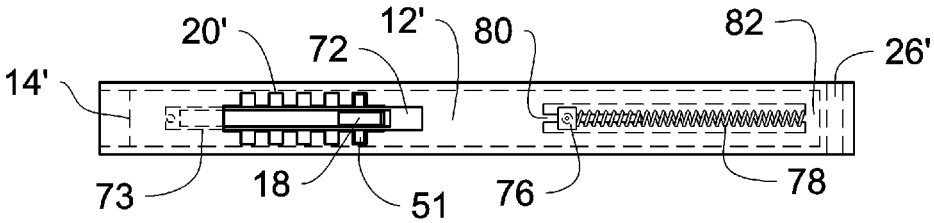
FIG. 15 is a top plane view of an alternate embodiment of the external handle and retractable sheath of the utility knife system of the present invention in FIG. 13 with the sheath retracted.
Figure 16:
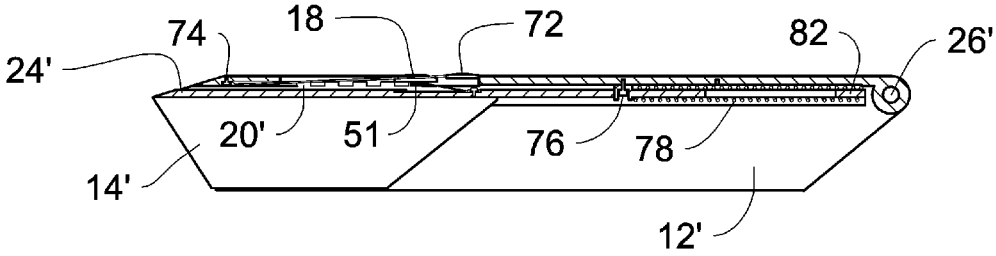
FIG. 16 is a front elevational view of an alternate embodiment of the external handle and retractable sheath of the utility knife system of the present invention in FIG. 13 with the sheath retracted.

This alternate embodiment external handle 12' further has a coil spring holder 76 removable attachable to different positions to the interior of the external handle 12' via fastener and a leaf spring release 72 attachable to the external handle via a fastener 74. The sheath 14' further has an opening with a pair of protrusions 80, 82 facing each other and positioned within the opening. A coil spring 78 is positioned over one of the protrusions 80, 82 and the coil spring holder 76. When the coil spring holder 76 is pointing toward the hinge 26' of the external handle 12', the sheath 14' is spring loaded for the retraced position so when the user compresses the leaf spring release 72 which disengages retracting mechanism 18 allowing retracting mechanism 18 to slide along running bars 73, thereby retracting the sheath 14' into the external handle 12', as best illustrated in FIGS. 13 and 14. When the coil spring holder 76 is pointing away from the hinge 26', the sheath 14' is spring loaded for the encased position so when the user compresses the leaf spring release 72 which disengages retracting mechanism 18 allowing retracting mechanism 18 to slide along running bars 73, thereby projecting the sheath 14' out from the external handle 12', as best illustrated in FIGS. 15 and 16.

The leaf spring release 72 has two running bars 73 parallel to each other. Inside the locking cutouts 20' of the external handle 12' is a straight track cut perpendicular to the cutouts 20'. This track houses the two running bars 73 and is set at a depth deeper than the cutouts 20' so the locking fingers 51 or the retracting mechanism 18 can engage the cutouts 20'. When the leaf spring release 72 is compressed, the running bars 73 push the locking fingers 51 below the cutouts 20'. Once the locking fingers 51 have disengaged from the cutouts 20', the locking fingers 51 slide along the running bars 73 and the sheath 14' is free to slide forward or backward via the coil spring 78. To compress the coil spring 78 to either the open or closed position, again depending on the position of the coil spring holder 76, the user simply compresses the retracting mechanism 18 and moves the sheath 14' accordingly. This alternated embodiment external handle 12' and sheath 14' can be incorporated into any embodiments of the present invention.

Figure 17:
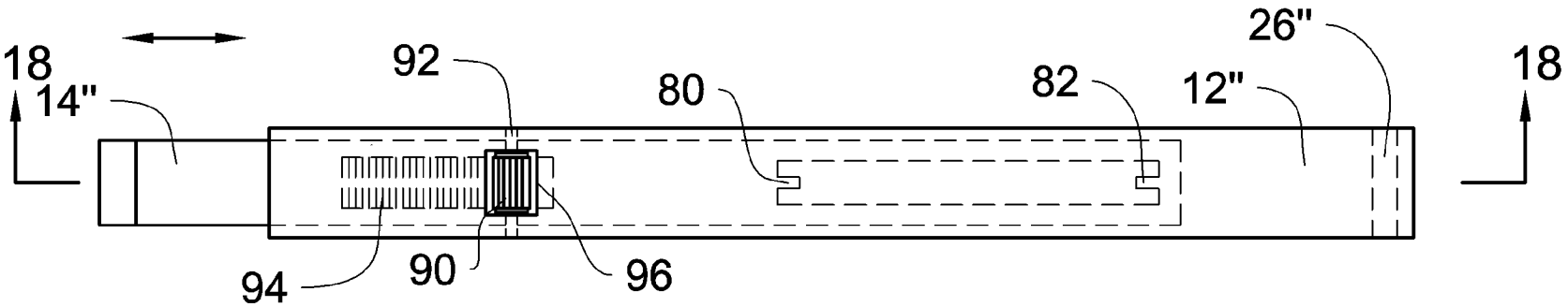
FIG. 17 is a top plane view of an alternate embodiment of the external handle and retractable sheath of the utility knife system of the present invention.
Figure 18:
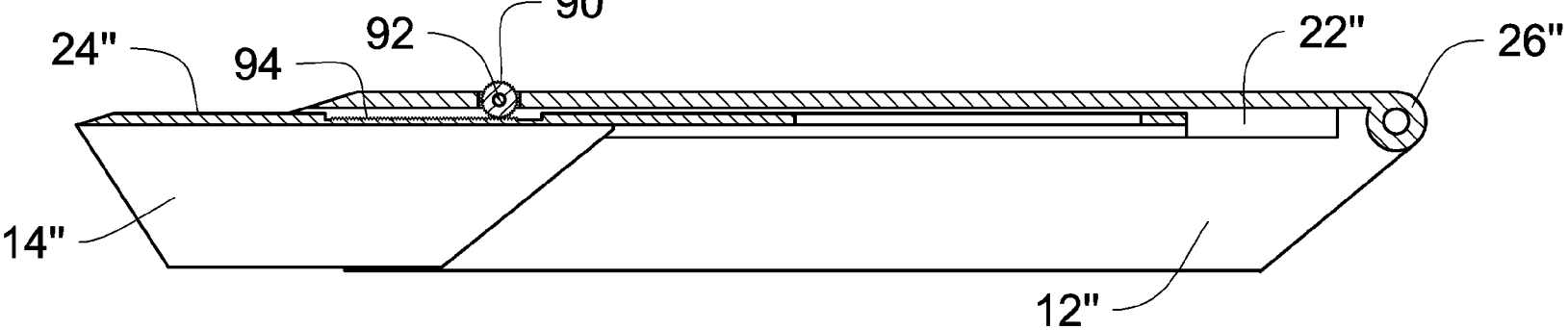
FIG. 18 is a front elevational view of the alternate embodiment of the external handle and retractable sheath of the utility knife system of the present invention in FIG. 17.

FIGS. 17 and 18 shows an alternate embodiment of the external handle 12 and sheath 14, with the above described retracting mechanism being a wheel and track system. The external handle 12" has three sides giving it a generally U-shape or horseshoe configuration, which encases the international housing 16. The external handle 12" has at least one sheath sliding track 22" running longitudinal therein on its top side, a hinge 26" located opposite the locking cutouts 20", and a wheel 90 rotatably mounting to the handle 12" via a shaft or pin 92. The wheel 90 has a plurality of radially oriented teeth. The hinge 26" is removably or fixedly attached to the pivot pin of the internal housing 16.

The retractable sheath 14" has the same configuration as the external handle 12", and is adapted to slide therein along the tracks 22'". The sheath 14" has protrusions 24" that extend out and correspond to the shape of the tracks 22", and additionally has a geared track 94. The geared track 94 corresponds to and engages with the teeth of the wheel 90. The sheath 14" is designed to cover the blade when it is extended out from the external handle 12", thereby protecting the blade and the user. The movement of the sheath 14" is accomplished by the wheel 90. To retract the sheath 14" the wheel 90 is rotated forward, away from the hinge 26", by the user. To extend the sheath 14" the wheel 90 is rotated backward, toward the hinge 26", by the user.

Figure 19:
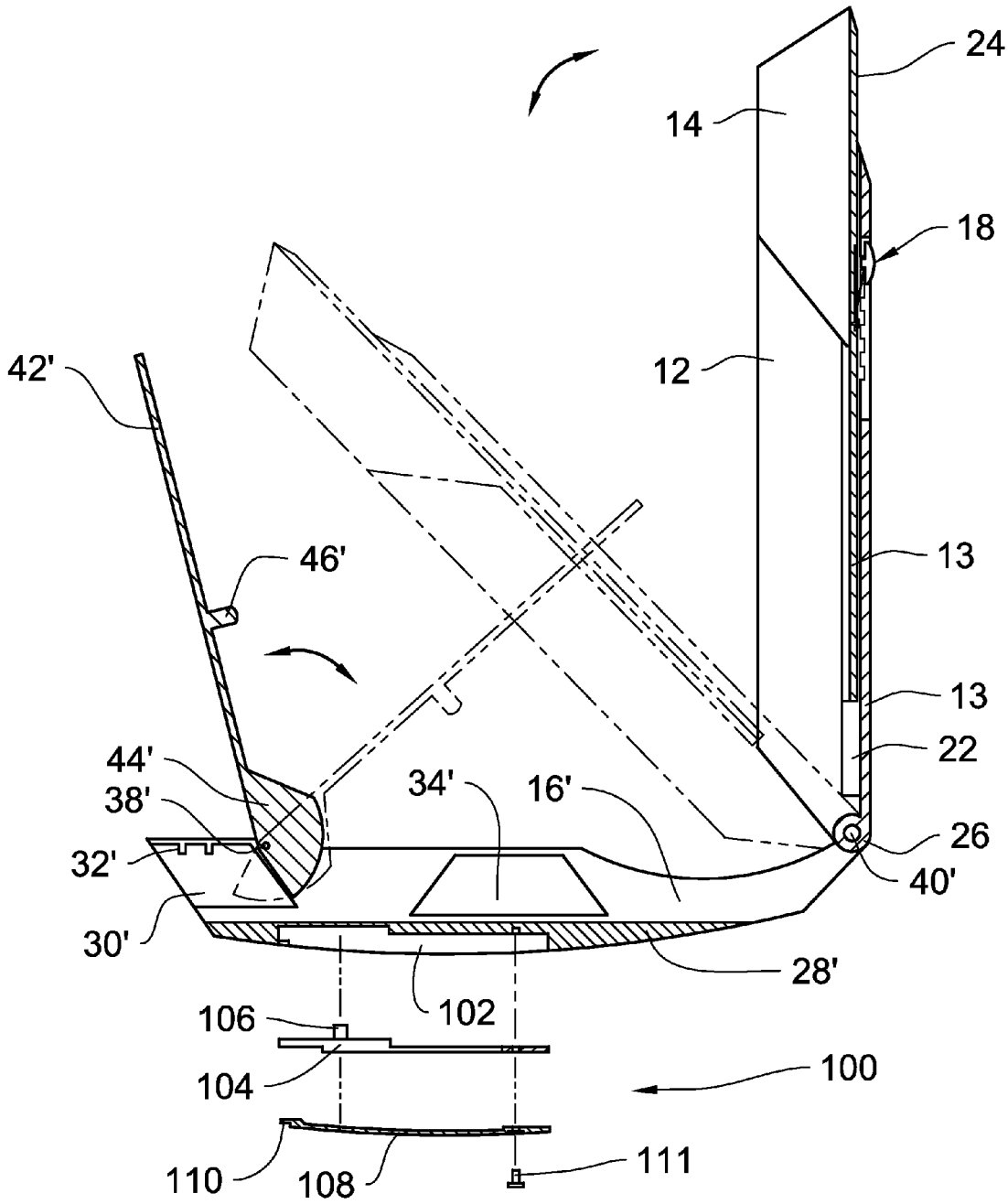
FIG. 19 is an exploded partial cross-sectional view of an alternate embodiment of the utility knife system of the present invention.
Figure 20:
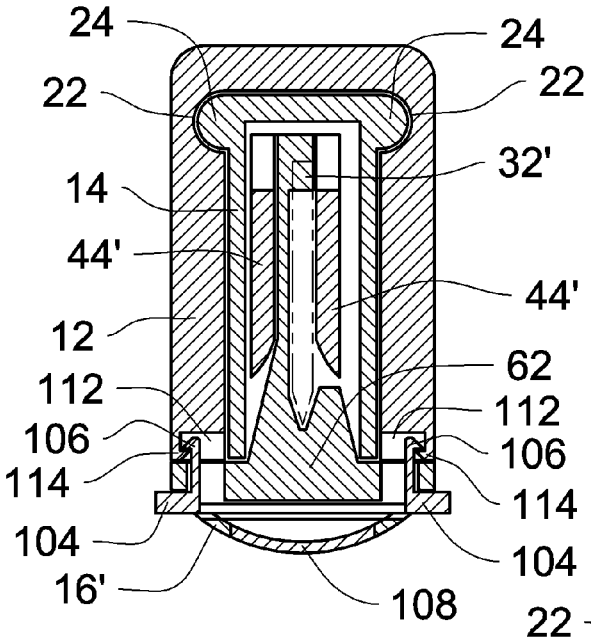
FIG. 20 is a cross-sectional view of the alternate embodiment of the utility knife system of the present invention in FIG. 19.
Figure 21:
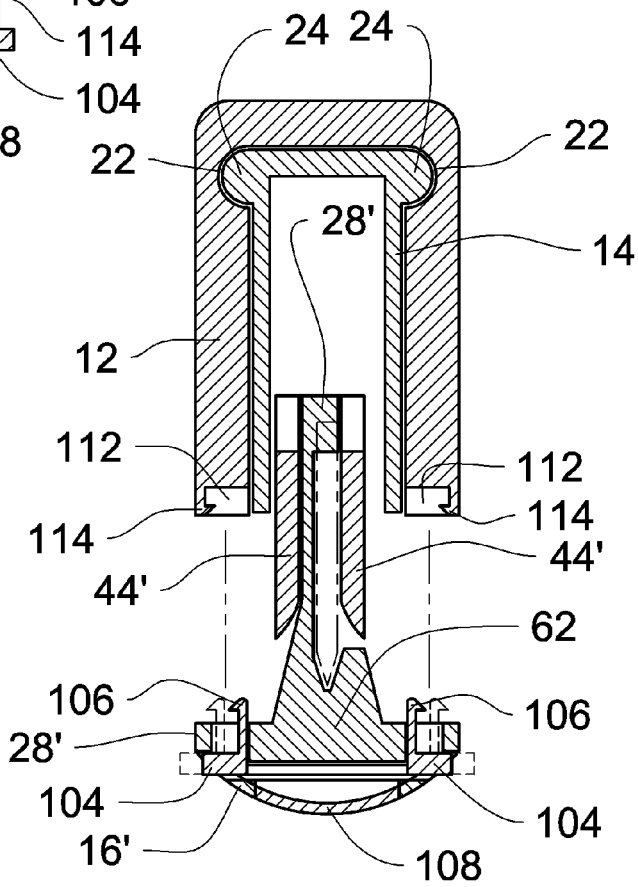
FIG. 21 is an exploded cross-sectional view of the alternate embodiment of the utility knife system of the present invention in FIG. 20.

FIGS. 19-21 shows an optional locking device 100 locking located in an opening 102 in the bottom of the internal housing 16'. It can be appreciated that the locking device 100 can be incorporated into any of the embodiments of the present invention, and for simplicity of explanation only one embodiment is herewith describe and illustrated. The locking device 100 has a wishbone spring 104 featuring a pair of hooks 106 extending up from parallel ends of the wishbone spring 104. The hooks 106 pass through the support ridge 28' and extend up therefrom. The wishbone spring 104 is received in the opening 102. A cover 108 is positionable over the wishbone spring 104 and is secured to the internal housing 16'. The cover 108 has a tab 110 which engages a lip in the opening 102. A fastener 111 secures the cover to the internal housing 16', and which passes through the wishbone spring 104 opposite the hooks 106.

The external handle 12 has grooves 112 featuring latches 114 which are positioned to receive and retain the hooks 106 when inserted therein. To lock the external handle 12 to the internal housing 16' the user would simply fold the external handle 12 to the closed position then the hooks 106 will engage the latches 114 in the grooves 112. To unlock, the user would squeeze the wishbone spring 104, thereby moving the hooks 106 away from the latches 114 and allowing the external handle 12 to separate from the internal housing 16', as best illustrated in FIG. 21.

Figure 22:
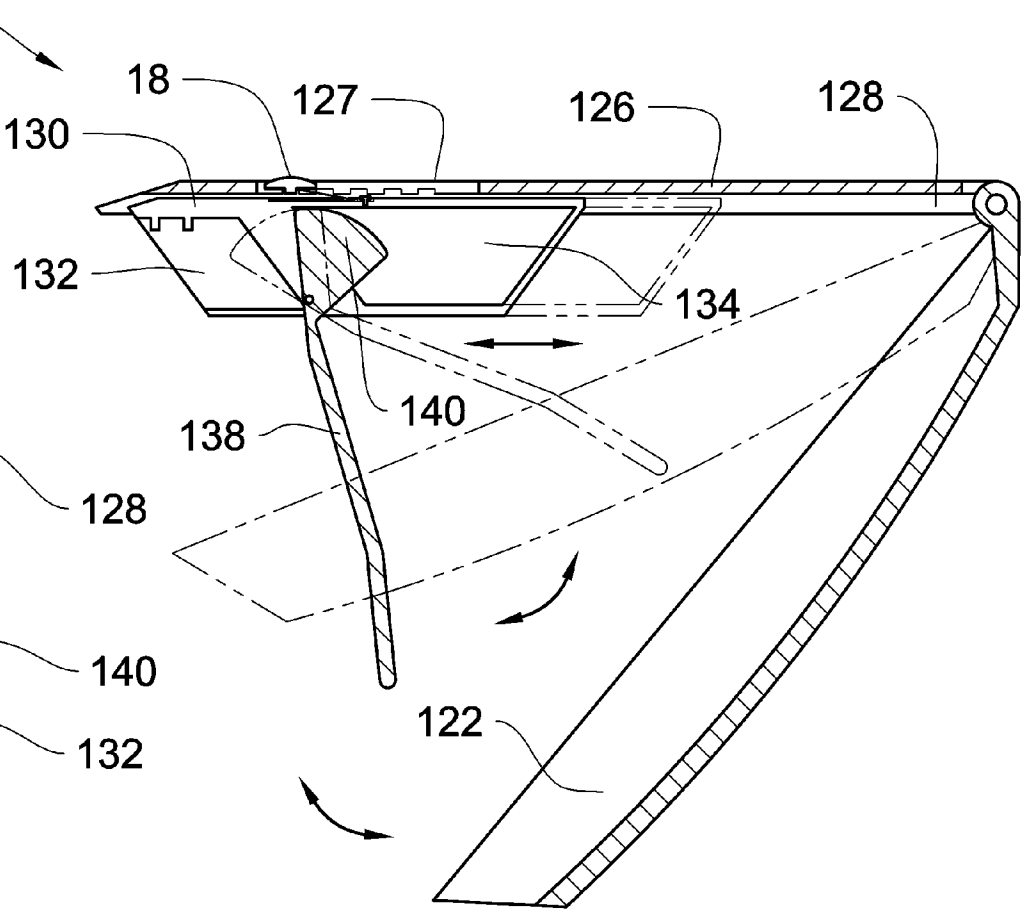
FIG. 22 is an exploded partial cross-sectional view of an alternate embodiment of the utility knife system of the present invention.

FIG. 22 shows an alternate embodiment utility knife system 120 having an external handle 122, an internal housing 130, and a rotating arm 138. The external handle 122 has a base 126 pivotally connected to the handle 122 via a hinge and pin connection 124, and a sliding track 128 running longitudinally along the length of the base 126. The external handle 122 has three sides giving it a generally U-shape or horseshoe configuration, which encases the internal housing 130 and the rotating arm 138. The base 126 includes locking cutouts 127 which provides an opening for a retracting mechanism 18 to extend therethrough, allowing the user access and operation thereof. The operation of the retracting mechanism 18 and cutouts 127 are identical to that as describe above. The external handle 122 and the base 126 can be ergonomically designed for a more comfortable and secure grip by the user.

The internal housing 130 has protrusions 136, a blade seat 132, a blade storage area 134, and the retracting mechanism 18. The protrusions 136 correspond to the configuration of the sliding track 128 of the base 126 thereby allowing the internal housing 130 to slide along the tracks 128 in cooperation with the retracting mechanism 18. The blade seat 132 features blade retaining prongs that extend into the blade seat 132 and secures a cutting blade therein. The blade retaining prongs prevents the cutting blade from moving forward and collapsing into the external handle 122. The internal housing 130 further includes an arm pivot pin 142 positioned between the blade seat 132 and the blade storage area 134.

Figure 23:
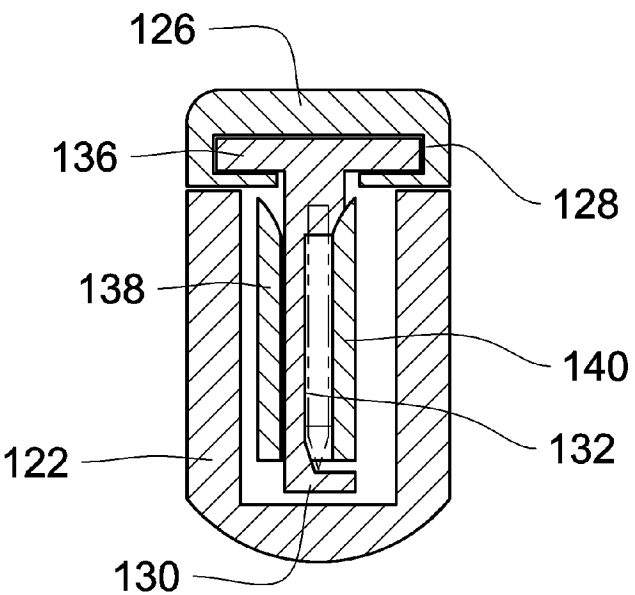
FIG. 23 is a cross-sectional view of the alternate embodiment of the utility knife system of the present invention in FIG. 22.

The rotating arm 138 has a wedge 140 and is pivotably attachable to the arm pivot pin 142 of the internal housing 130. The pivot attachment point is positioned adjacent the wedge 140. The wedge 140 has two sides which makes contact with the cutting blade 19 and the backside of the blade seat 132. The side of wedge 140 that makes contact with blade 19 can be arcuate. When the arm 138 is closed, it will fit within the internal housing 130, thereby being enclosed by the external housing 122, as best illustrated in FIG. 23.

Figure 24:
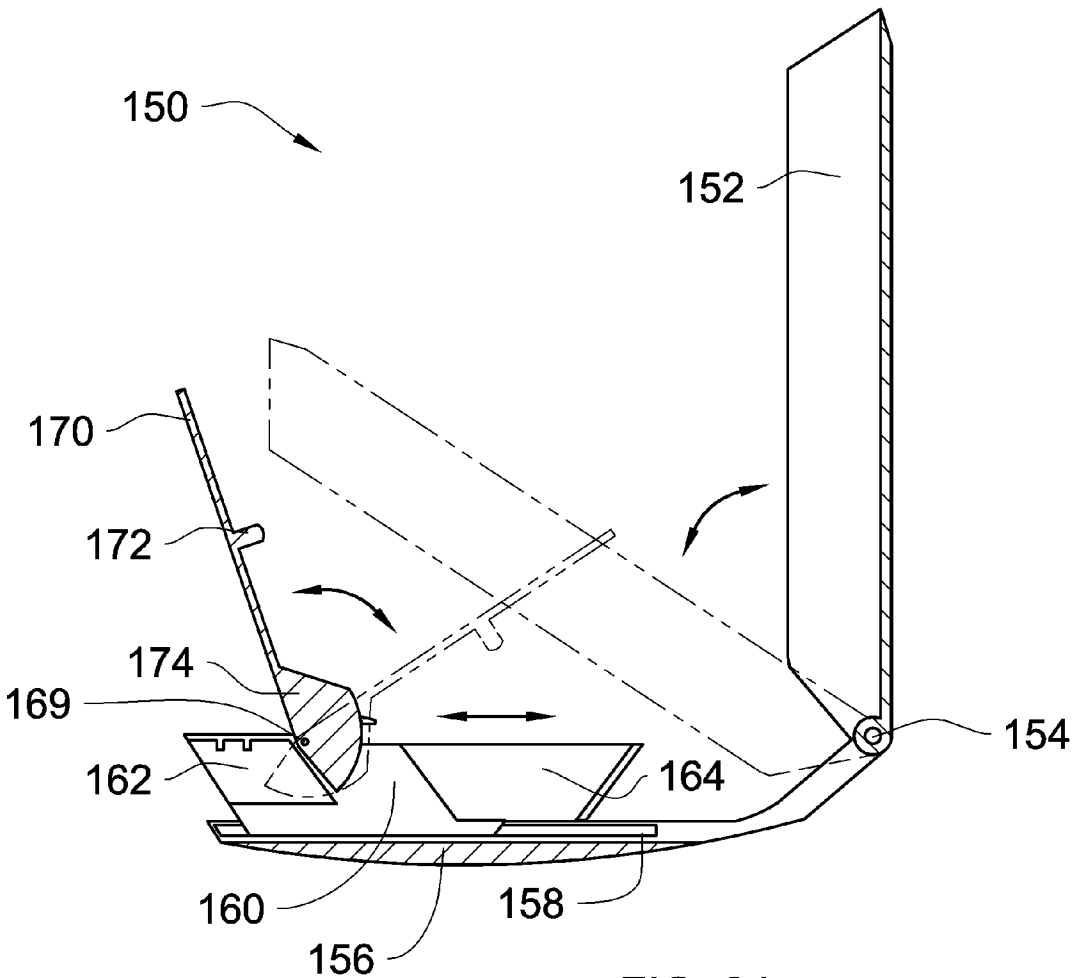
FIG. 24 is an exploded partial cross-sectional view of an alternate embodiment of the utility knife system of the present invention.
Figure 26:
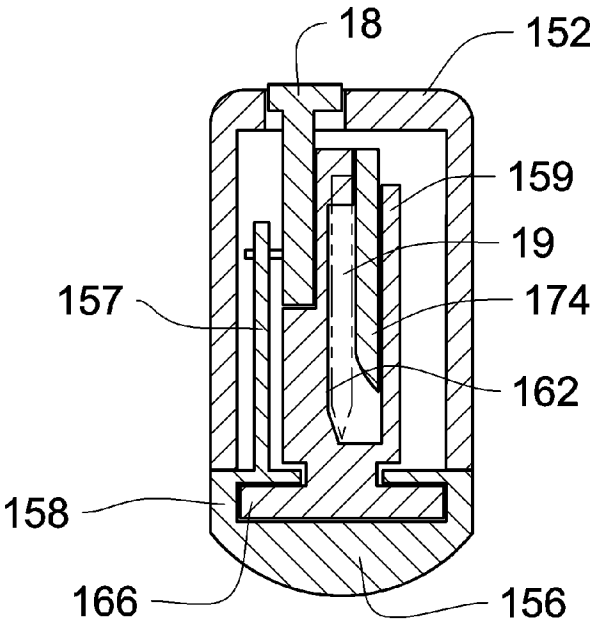
FIG. 26 is a cross-sectional view of the alternate embodiment of the utility knife system of the present invention in FIG. 24.
Figure 25:
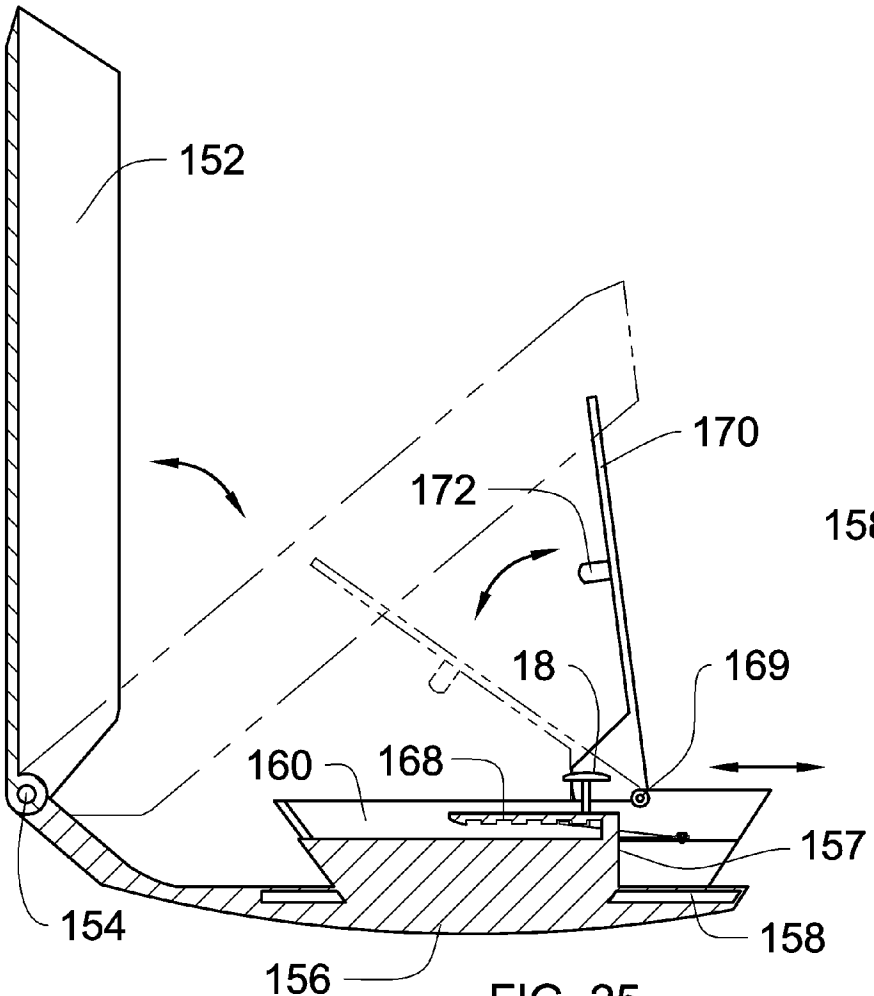
FIG. 25 is an exploded partial cross-sectional view of the alternate embodiment of the utility knife system of the present invention in FIG. 24.

FIGS. 24-26 shows an alternate embodiment 150 of embodiment 120. Embodiment 150 has an external handle 152, an internal housing 160, and a rotating arm 170. The external handle 152 has a base 156 pivotally connected to the handle 152 via a hinge and pin connection 154, and a sliding track 158 running longitudinally along the length of the base 156. The external handle 152 has three sides giving it a generally U-shape or horseshoe configuration, which encases the internal housing 160 and the rotating arm 170. The base 156 includes a pair of support ridges that extend out therefrom and locking cutouts 168 which corresponds to a retracting mechanism 18. The support ridges are flanges that extend outward from both sides of the base 156 thereby producing a generally T-shaped configuration, thereby supporting the external handle 152 when in a closed position. The locking cutouts 168 are positioned on a 90 degree arm 157 mounted to the base 156. The external handle 152 has an opening allowing the retracting mechanism 18 to pass therethrough. The external handle 152 and the base 156 can be ergonomically designed for a more comfortable and secure grip by the user.

The retracting mechanism 18 is attached to the internal housing 160 and has a leaf spring attached to the top of a support wall that is one half the height of the internal housing 160. The operation of the retracting mechanism 18 and cutouts 168 are similar to that as describe above.

The internal housing 160 has protrusions 166, a blade seat 162, a blade storage area 164, and the retracting mechanism 18. The protrusions 166 correspond to the configuration of the sliding track 158 of the base 156 thereby allowing the internal housing 160 to slide along the tracks 158 in cooperation with the retracting mechanism 18, as best illustrated in FIG. 26. The blade seat 162 features blade retaining prongs that extend into the blade seat 162 and secures a cutting blade therein. The blade retaining prongs prevents the cutting blade from moving forward and collapsing into the external handle 152. The internal housing 160 further includes an arm pivot pin 169 positioned between the blade seat 162 and the blade storage area 164.

The rotating arm 170 has a wedge 174 and an extension 172 and is pivotably attachable to the arm pivot pin 169 of the internal housing 160. The pivot attachment point is positioned adjacent the wedge 174. The wedge 174 has only one side which makes contact with the cutting blade 19, which can be arcuate. Wedge 174 goes between wall 159 and cutting blade 19. When the arm 170 is closed, it will fit within the internal housing 160, thereby being enclosed by the external housing 152, as best illustrated in FIG. 26.

Figure 27:
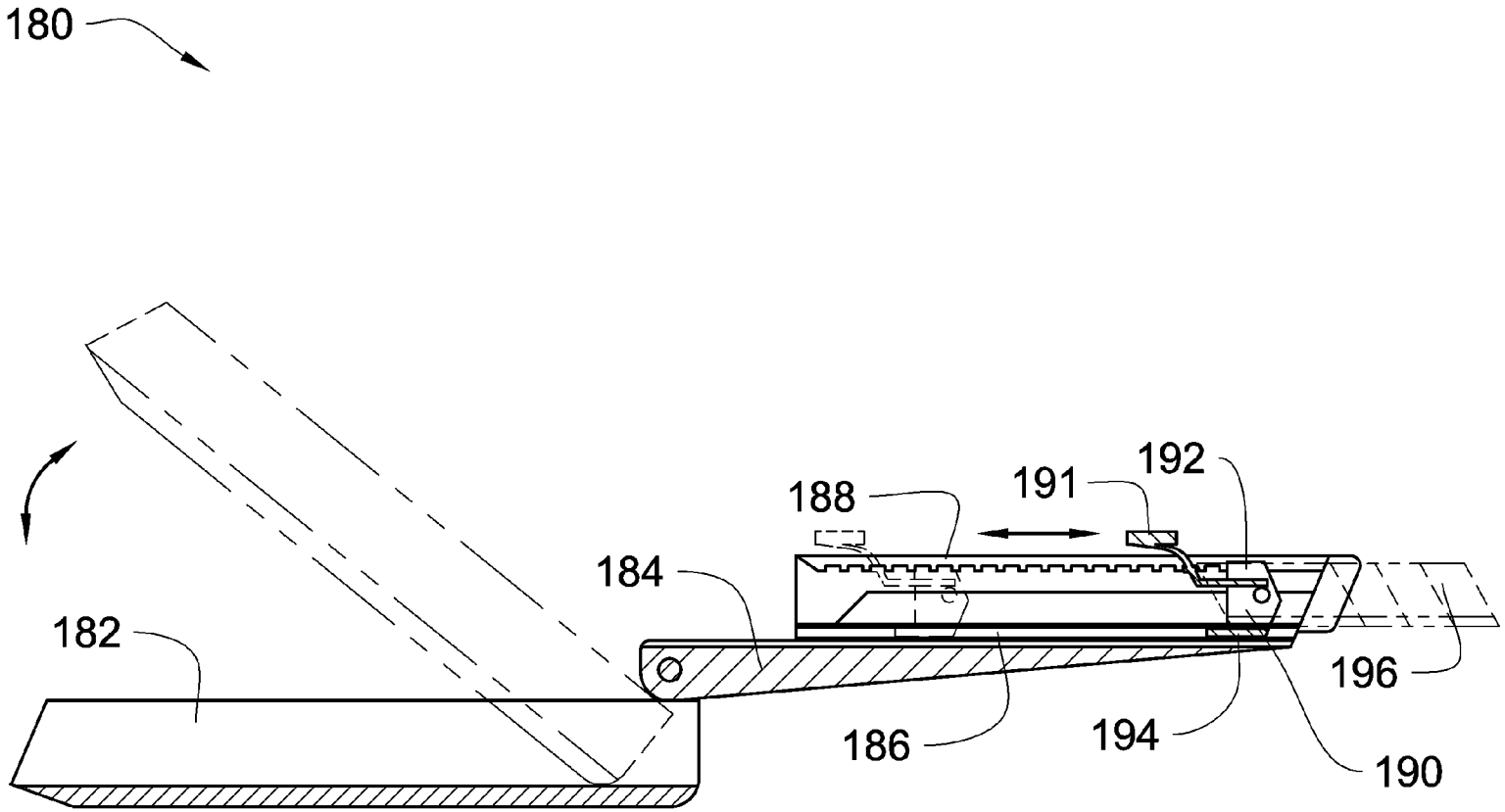
FIG. 27 is an exploded partial cross-sectional view of an alternate embodiment of the utility knife system of the present invention.
Figure 28:
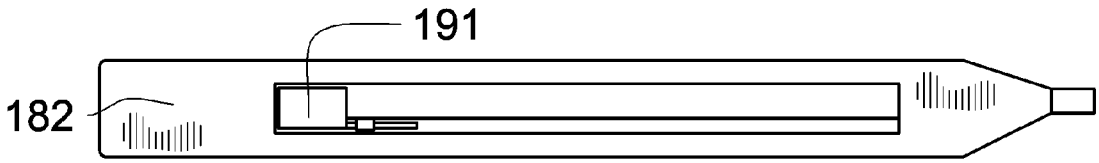
FIG. 28 is a top plane view of the alternate embodiment of the utility knife system of the present invention, in FIG. 27.
Figure 29:
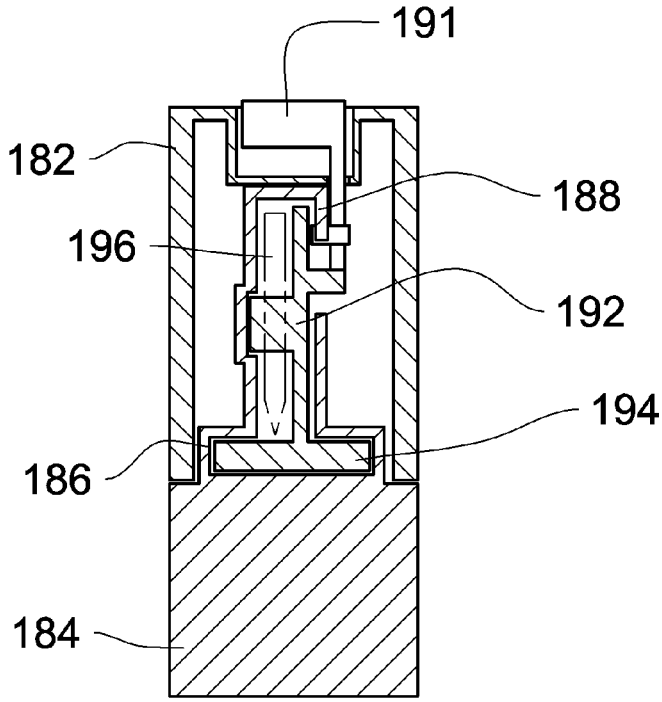
FIG. 29 is a partial cross-sectional view of the alternate embodiment of the utility knife system of the present invention, in FIG. 27.

FIGS. 27-29 shows an alternate embodiment 180 of the present invention. Embodiment 180 is designed for disposable break off (long) blades and has an external handle 182, an internal housing 184, and a retracting mechanism 190. The external handle 182 has three sides giving it a generally U-shape or horseshoe configuration, which encases the internal housing 184 and the retracting mechanism 190. The external handle 182 is pivotally connected to the internal housing 184.

The internal housing 184 has a sliding track 186 and cutouts 188 located above the sliding track 186. The retracting mechanism 192 includes a thumb lever 191, a blade seat 192, and protrusions 194. The thumb lever 191 is connected to the blade seat 192 via a spring arm, and has locking fingers extend out therefrom so as to engage with the cutouts 188, similar to the retracting mechanism described above. The blade seat 192 is adapted to retain a long blade 196 having sections that can break off when dull. The protrusions 194 are attached to the bottom section of the blade seat 192 and correspond to the configuration of the sliding track 186, thereby allowing the retracting mechanism 190 to slide along the sliding track 186.

The retracting mechanism 190 has three functions. Firstly, to keep the blade 196 stable in the internal housing 184. Secondly, to retract and/or extend the blade 196 from the external handle 182. Thirdly to lock the blade 196 in a desired position.

The present invention has features that conform to standards that are established in the utility knife industry. Specifically the replaceable blades are standard size and shape as shown in the drawings in phantom. The present invention can be adapted to conform to different replaceable blade shapes and sizes, as well as different handle and cutting blade retention means.

In use, it can now be understood that a user would insert a disposable blade into the blade seat of the internal housing. Then secure the blade in the blade seat by pivoting the rotating arm so that the wedge makes contact with the blade and pinches the blade against the blade seat. The external housing is rotated to its closed position thereby encasing the internal housing and rotating arm. The user would then operate the retracting mechanism to either extend or retract the sheath, the internal housing, or the blade.

While a preferred embodiment of the utility knife system has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as metal, plastic, or a variety of composites may be used. And although cutting objects safely and effectively have been described, it should be appreciated that the utility knife system herein described is also suitable for scribing objects.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A utility knife system for cutting objects safely and effectively, said utility knife system comprising:

an external handle having a substantially U-shaped configuration, and a sliding track;

a hinge located at one end of said external handle;

a retractable sheath having a substantially U-shaped configuration, said retractable sheath being adapted to slide within said external handle along said sliding track;

a retracting mechanism adapted to move said retractable sheath;

an internal housing having a pair of support ridges extending out from the bottom thereof to produce a substantially T-shaped configuration, a pivot point attachable to said hinge, and a blade retention end opposite of said pivot point, said blade retention end being adapted to receive a cutting blade, said support ridges being adapted to support said U-shaped external handle when in a closed position thereby allowing said internal housing to be received within said retractable sheath and said external handle; and an arm having a rotatable attachment point adapted to rotatably connect said arm to said internal housing, and a wedge adapted to secure a cutting blade in said blade retention end when said arm is rotated down.

2. The utility knife system of claim 1, wherein said sliding track running longitudinally within said external handle, wherein said retractable sheath further comprising at least one protrusion corresponding to the shape of said sliding track and adapted to slide along said sliding track, and wherein said blade retention end of said internal housing further comprising a blade seat adapted to receive and retain a cutting blade.

3. The utility knife system of claim 2, wherein said external handle further comprising at least one locking cutout, and wherein said retracting mechanism further comprising a leaf spring trigger and at least one locking finger, said retracting mechanism being attachable to said retractable sheath allowing for said at least one locking finger to engage with said at least one locking cutout of said external handle.

4. The utility knife system of claim 3, wherein said internal housing further comprising a cutting blade storage area positioned between said blade retention area and said pivot point, and wherein said arm further comprising an extension positioned to correspond to said cutting blade storage area when said arm is in a down position, said extension adapted to retain a cutting blade in said cutting blade storage area when said arm is rotated in the down position.

5. The utility knife system of claim 4, wherein said wedge of said arm is positioned adjacent said rotatable attachment point opposite said extension of said arm, and said rotatable attachment point being located between said blade seat and said pivot point of said internal housing.

6. The utility knife system of claim 4, wherein said wedge of said arm is positioned between said rotatable attachment point and said extension of said arm, and said rotatable attachment point being located at said blade retention end and adjacent said blade seat opposite said support ridges of said internal housing.

7. The utility knife system of claim 4, wherein said wedge of said arm is positioned adjacent said rotatable attachment point, and said rotatable attachment point being positioned between said blade seat and said pivot point of said internal housing.

8. The utility knife system of claim 7, wherein said external handle further comprising at least one running bar removably attachable to said external handle and located adjacent said at least one locking cutout, said at least one running bar being adapted to make contact with said at least one locking finger of said retracting mechanism.

9. The utility knife system of claim 8, wherein said retractable sheath further comprising at least one protrusion extending in a defined opening, and wherein said external handle further comprising a coil spring and a coil spring holder removable attachable to said external handle and positionable within said opening of said retractable sheath, said coil spring being positioned between said coil spring holder and said at least one protrusion of said retractable sheath.

10. The utility knife system of claim 2, wherein said external handle further comprising a rotatable wheel including a plurality of teeth, and wherein said retracting mechanism further comprising a geared track positioned to engage with said wheel of said external handle.

11. The utility knife system of claim 7, wherein said external handle further comprising at least one groove, and wherein said internal housing further comprising a wishbone spring including at least one hook, said hook being adapted to engage said groove when said external handle is pivoted down and over said internal housing.

12. A utility knife system comprising:

an external handle having a substantially U-shaped configuration, at least one sliding track running longitudinally therein, and a hinge located at one end of said external handle;

a retractable sheath having a substantially U-shaped configuration, and at least one protrusion corresponding to the shape of said sliding track, said retractable sheath being adapted to slide within said external handle;

a retracting mechanism adapted to move said retractable sheath and lock said retractable sheath in position;

an internal housing having a pair of support ridges extending out from the bottom thereof to produce a substantially T-shaped configuration, a pivot pin attachable to said hinge of said external handle, a blade retention end opposite of said pivot pin, and a cutting blade storage area positioned between said blade retention area and said pivot pin, said blade retention end having a blade seat adapted to receive a cutting blade, said support ridges being adapted to support said U-shaped external handle when in a closed position thereby allowing said internal housing to be received within said retractable sheath and said external handle; and an arm having a rotatable attachment point adapted to rotatably connect said arm to said internal housing, a wedge adapted to secure a cutting blade in said blade retention end when said arm is rotated down, and an extension positioned to correspond to said cutting blade storage area when said arm is in a down position, said extension being adapted to retain a cutting blade in said cutting blade storage area when said arm is rotated in the down position.

13. The utility knife system of claim 12, wherein said external handle further comprising at least one locking cutout, and wherein said retracting mechanism further comprising a leaf spring trigger and at least one locking finger, said retracting mechanism being attachable to said retractable sheath allowing for said at least one locking finger to engage with said at least one locking cutout of said external handle.

14. The utility knife system of claim 13, wherein said wedge of said arm is positioned adjacent said rotatable attachment point opposite said extension of said arm, and said rotatable attachment point being located between said blade seat and said pivot pin of said internal housing.

15. The utility knife system of claim 13, wherein said wedge of said arm is positioned between said rotatable attachment point and said extension of said arm, and said rotatable attachment point being located at said blade retention end and adjacent said blade seat opposite said support ridges of said internal housing.

16. The utility knife system of claim 13, wherein said wedge of said arm is positioned adjacent said rotatable attachment point, and said rotatable attachment point being positioned between said blade seat and said pivot point of said internal housing.

17. The utility knife system of claim 16, wherein said external handle further comprising at least one running bar removably attachable to said external handle and located adjacent said at least one locking cutout, said at least one running bar being adapted to make contact with said at least one locking finger of said retracting mechanism.

18. The utility knife system of claim 17, wherein said retractable sheath further comprising at least one protrusion extending in a defined opening, and wherein said external handle further comprising a coil spring and a coil spring holder removable attachable to said external handle and positionable within said opening of said retractable sheath, said coil spring being positioned between said coil spring holder and said at least one protrusion of said retractable sheath.

19. The utility knife system of claim 12, wherein said external handle further comprising a rotatable wheel including a plurality of teeth, and wherein said retracting mechanism further comprising a geared track positioned to engage with said wheel of said external handle.

20. The utility knife system of claim 16, wherein said external handle further comprising at least one groove, and wherein said internal housing further comprising a wishbone spring including at least one hook, said hook being adapted to engage said groove when said external handle is pivoted down and over said internal housing.

* * * * *